US006120162A

United States Patent [19]

Guerrieri

[11] Patent Number: 6,120,162

[45] Date of Patent: Sep. 19, 2000

[54] AUTOMATED MAGNETIC ACTUATION SYSTEM FOR INNER ILLUMINATING A PERSONAL EFFECTS CARRYING CONTAINER SUCH AS A PURSE KNAPSACK OR FANNY PACK

[76] Inventor: Salvatore Guerrieri, 481 Eighth Ave., Suite 1501, New York, N.Y. 10001

[21] Appl. No.: 09/025,689

[22] Filed: Feb. 18, 1998

Related U.S. Application Data

[60] Provisional application No. 60/038,443, Feb. 19, 1997.

[51] Int. Cl.[7] ..... A45C 15/06

[52] U.S. Cl. ..... 362/155; 362/156; 362/276

[58] Field of Search ..... 362/154, 155, 362/156, 276, 802

[56] References Cited

U.S. PATENT DOCUMENTS

| | | | |
|---|---|---|---|
| 1,781,835 | 11/1930 | Emmes et al. | 362/154 |
| 2,218,396 | 10/1940 | Hallbauer | 240/6.45 |
| 2,689,907 | 9/1954 | Wilson | 362/155 |
| 3,330,949 | 7/1967 | Bush | 240/6.45 |
| 3,800,134 | 3/1974 | Castaldo | 362/155 |
| 4,091,443 | 5/1978 | Ohrenstein et al. | 240/6.4 |
| 4,654,763 | 3/1987 | Knight | 362/156 |
| 4,872,095 | 10/1989 | Dubak et al. | 362/155 |
| 4,912,611 | 3/1990 | Lyle | 362/156 |
| 5,067,063 | 11/1991 | Granneman et al. | 362/156 |

FOREIGN PATENT DOCUMENTS

| | | | |
|---|---|---|---|
| 604604 | 9/1978 | Switzerland | 362/155 |

*Primary Examiner*—Y. Quach
*Attorney, Agent, or Firm*—Auslander & Thomas

[57] ABSTRACT

The present invention provides a magnetically actuated illumination system for a purse, knapsack or fanny pack. The system works to effectively control a battery operated light with magnet and reed switch turning the light of and on. The system can also be used with an integrated circuit timer. The actuation of the switch sets up a timed on cycle. The timed cycle prevents accidental wearing down of the battery by inadvertent actuation or neglect to turn off.

1 Claim, 3 Drawing Sheets

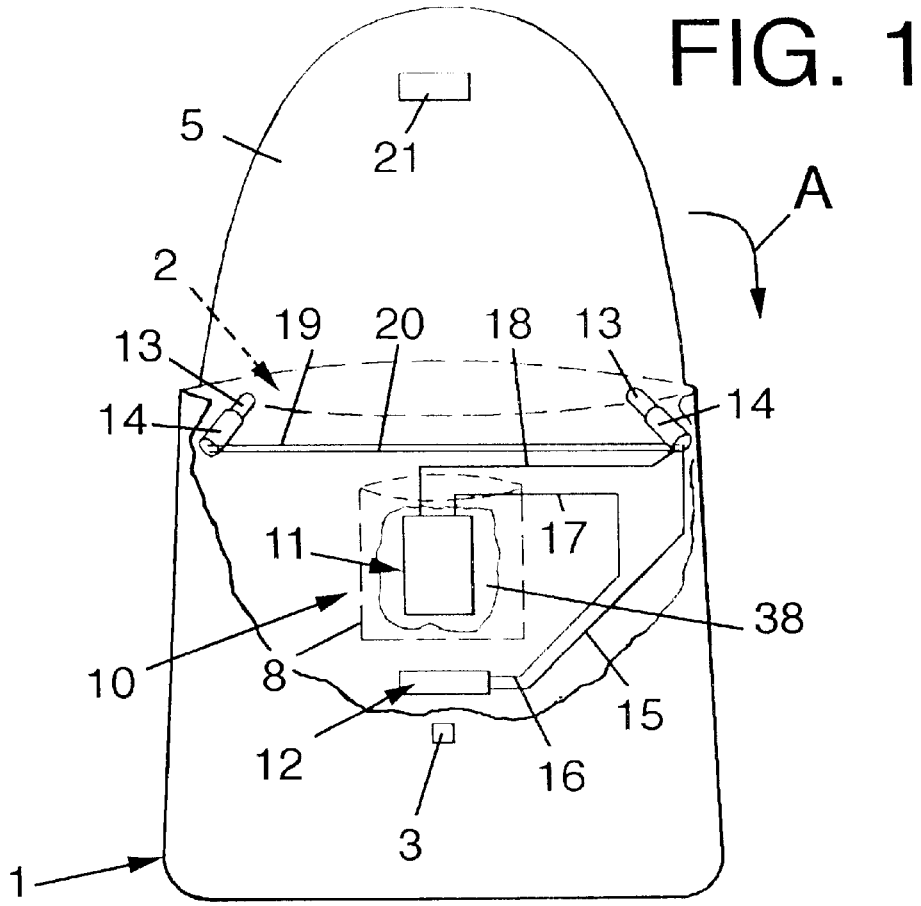
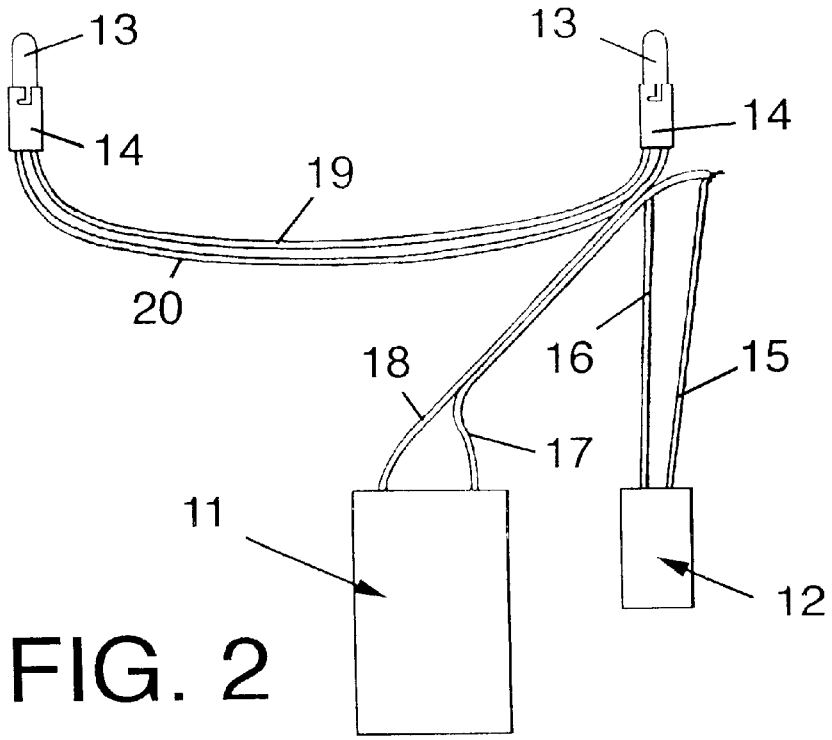
FIG. 2

FIG. 3
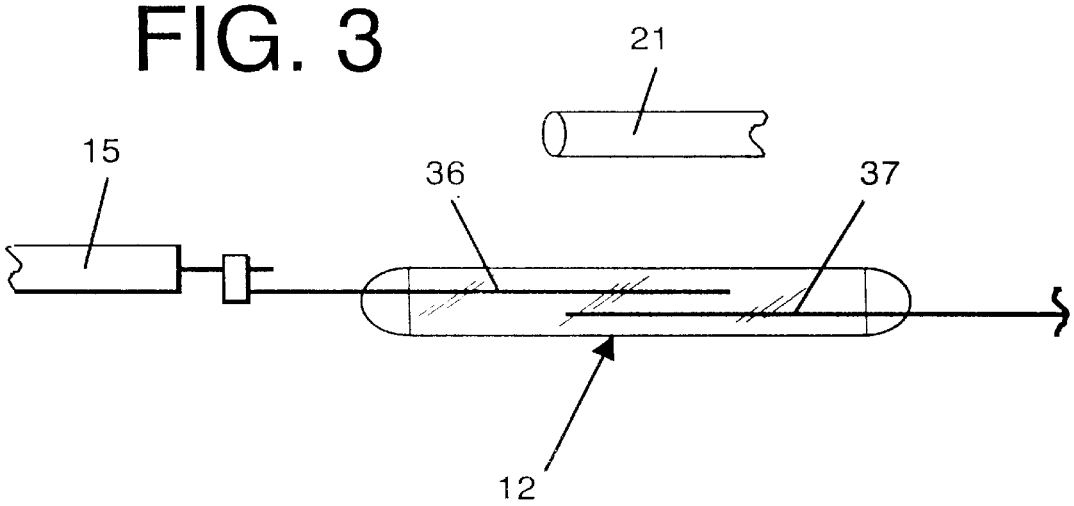
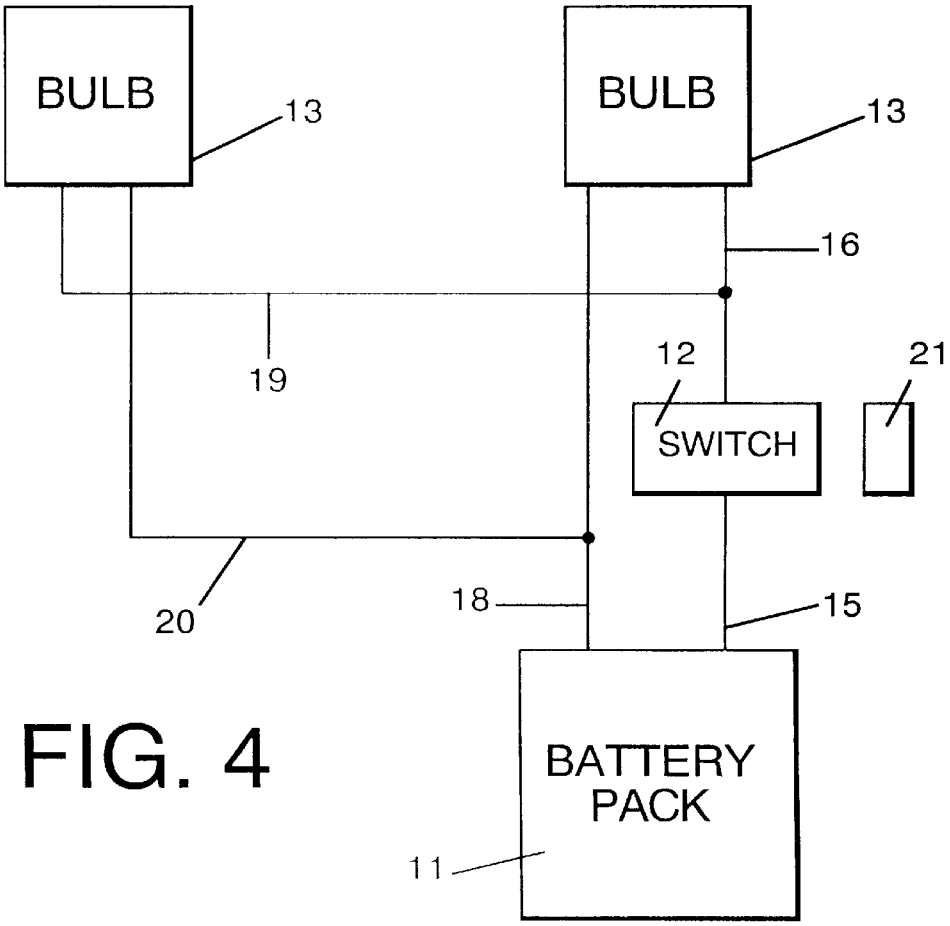
FIG. 4

AUTOMATED MAGNETIC ACTUATION SYSTEM FOR INNER ILLUMINATING A PERSONAL EFFECTS CARRYING CONTAINER SUCH AS A PURSE KNAPSACK OR FANNY PACK

The present invention is a continuation of Provisional Application Ser. No. 60/038,443 filed Feb. 19, 1997.

BACKGROUND OF THE INVENTION

1. Field of Invention

The present invention relates to a magnetic actuation system for the inner illumination of a container such as a purse, knapsack or fanny pack. The present invention provides automatic illumination to the inside of the carrying container when the closure is opened and may provide a timed light on cycle.

2. Description of Related Art

Numerous lighting systems exist for illuminating the interior of at least purses, or knapsacks or fanny packs. The present invention provides an improved interior lighting system for actuating and controlling interior lighting.

U.S. Pat. No. 2,218,396 discloses an early system implementing an incandescent lamp and conventional electrical contact switch combination fixture with mounting plate secured to the flap. When said flap is opened, the switch can be engaged to illuminate the compartment outside the purse.

U.S. Pat. No. 3,330,949 discloses a removable flashlight attachment for a lady's handbag with on demand manual operation of said flashlight using a conventional electrical contact. The switch is contained in a container with elastic properties.

U.S. Pat. No. 4,091,443 discloses an interior mirror with a multipurpose battery powered light for use inside a lady's handbag. This device also uses conventional electrical contacts. This device also functions as a removable light source.

U.S. Pat. No. 4,654,763 discloses a battery powered pocketbook light for the compartment of a pocketbook operated by manually operated switch with a double electrical contact actuating switch to prevent accidental actuation. Velcro® hook and loop pile fasteners secure the device.

U.S. Pat. No. 4,912,611 discloses a removable battery powered flashlight with a separate control switch. The light is controlled by a removable biased spring which is closed when the purse is opened. The flashlight may be removed and the light shown as an independent flashlight. The flashlight uses conventional electrical contacts.

U.S. Pat. No. 5,067,063 discloses a handbag illuminated with a battery powered electroluminescent lamp. Electroluminescent lamps are thin light emitting capacitors. This technology uses less current and generates less heat than incandescent or fluorescent bulbs. An inverter is used to convert the direct current from said battery to alternating current. A manually operated conventional electrical contact switch triggers the light.

It is respectfully requested that this citation of art be made of record with regard to the within application.

SUMMARY OF THE INVENTION

The present invention provides a magnetic automatic light actuating system for a purse, knapsack or fanny pack. A magnet on a closure flap is interactable with a switch means, such as a reed switch, so that on the opening of the flap, the magnet is removed from its station. Once the magnet is removed, the switch means is actuated, closing an electric circuit. The closed circuit turns on the internal light in the purse, knapsack or fanny pack. The reed switch is normally biased closed.

Removing the magnet from its station may also close an electric circuit to release an impact switch to actuate a timer circuit to provide a timed on light cycle, thus not wearing out the battery on an accidental actuation, or failure to restation the magnet.

The station normally comprises a magnet and a switching means. A reed switch is a preferred switching means. The reed switch is normally biased closed but held open by the magnet at the station. The same reed switch and magnet station also actuates the timed light cycle.

A principal object of the present invention is to provide an effective illuminating for a purse, knapsack or fanny pack that is automatically actuated by a magnetic reed electrical contact switch and regulated by a digital timer.

The magnetic reed switch uses resilient spring-like contacts in an inert atmosphere protected from moisture, dirt and other contaminants. It is not as markedly affected by physical contact wear and corrosion as is a conventional atmospheric contact switch. The reed switch of the present invention overcomes past longevity and weather-proofing shortcomings by eliminating the mechanical switch in favor of an electromagnetic reed switch.

A still further object is to provide an effective illuminating device for a purse, knapsack or fanny pack that is heavy duty and weather resistant and may operate in a damp or dirty outdoor setting without malfunctioning.

Another object is to provide an effective illuminating device for a purse, knapsack or fanny pack implementing a digital timer. The digital timer keeps the interior light from being lit for extended periods. Extended illumination creates deleterious heat and depletes the battery pack prematurely.

Another object is to provide a zipper pocket enabling easy removal of said battery pack for recharging or replacement.

Although such novel feature or features believed to be characteristic of the invention are pointed out in the claims, the invention and the manner in which it may be carried out may be further understood by reference to the description following and the accompanying drawings.

BRIEF DESCRIPTION OF THE DRAWINGS

FIG. 1 is a front elevation view of an open purse, with its front cut away and including the inner illuminating system of the present invention.

FIG. 2 is a detail block schematic of the automated magnetic actuation system of the present invention.

FIG. 3 is an exploded detail of the magnet and the open circuit reed switch.

FIG. 4 is a block diagram schematic of the automated magnetic actuation system for inner illuminating a personal effects carrying container.

Referring now to the figures in greater detail, where like reference numbers denote like parts in the various parts;

DETAILED DESCRIPTION OF THE PREFERRED EMBODIMENTS

Figure 5:
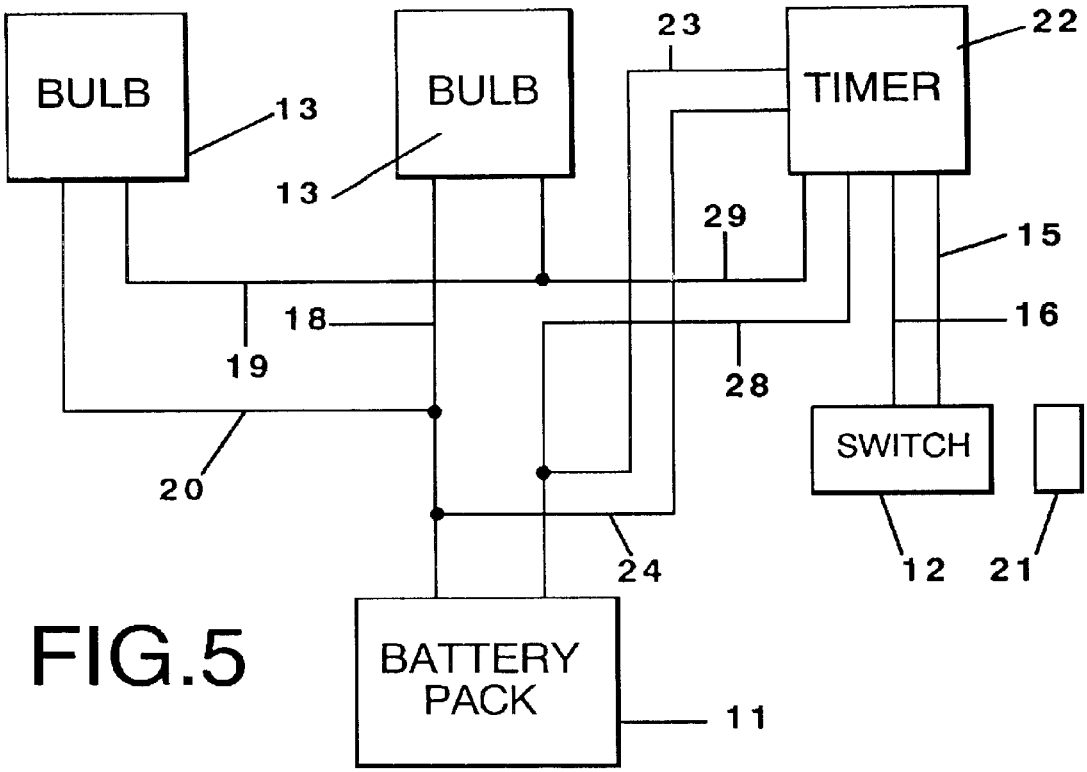
FIG. 5 is a block diagram schematic of another embodiment of the automated magnetic actuation system for inner illuminating a personal effects carrying container with a timed on cycle.

FIG. 1 shows the automated magnetic actuation system for inner illuminating 10 in a purse 1. The purse 1 has inner compartment 2 which holds the automated magnetic actuation system for inner illuminating 10 in a purse body 6.

As can be seen in FIG. 2, the automated magnetic actuation system for inner illuminating 10 comprises a battery pack 11, a switch 12, light bulbs 13 with bayonet type sockets 14. The switch 12 has a first lead wire 15 and a second lead wire 16. The first lead wire 15 is connected to the first lead wire 17 of the battery pack 11 and second lead wire 16 of the switch 12 is connected to one of the light sockets 14. The second lead wire 18 of the battery pack 11 is connected to the sockets 14. A lead wire 19 and a lead wire 20 lead to the other sockets 14 to allow a current to illuminate the second light bulbs 13 when the switch is actuated by the magnet 21.

As can be seen in FIG. 4, when the switch 12 is closed, the bulbs 13 are connected to the battery pack 11 and turned on.

Figure 6:
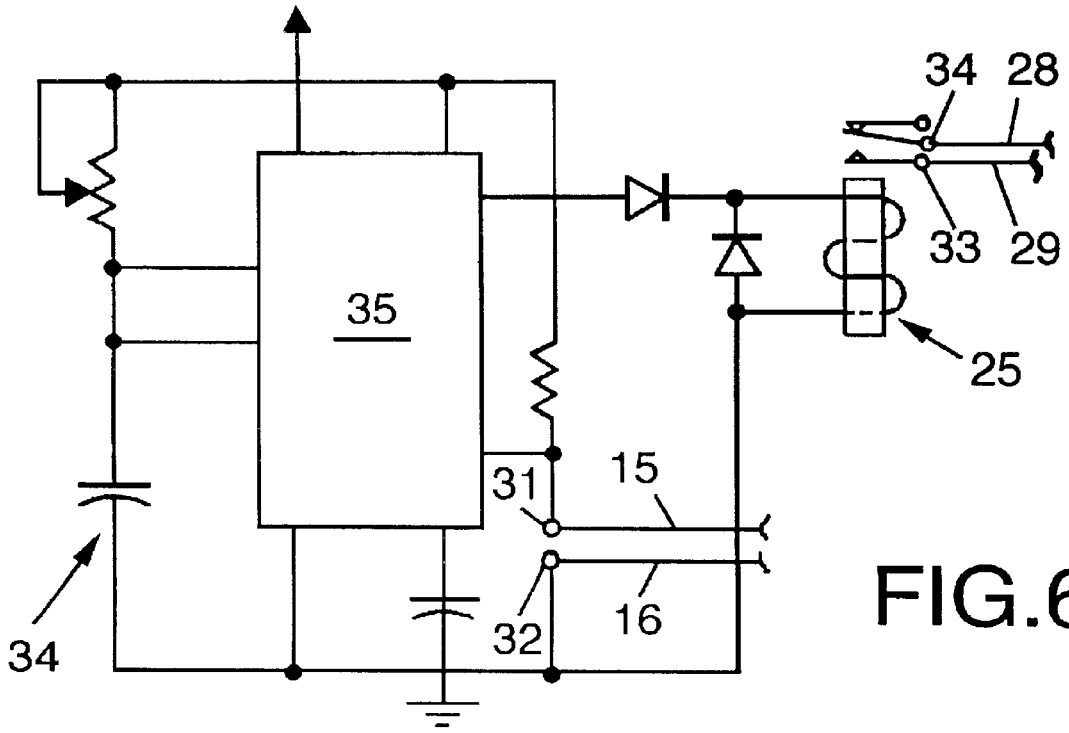
FIG. 6 is a typical schematic diagram of a timed delay circuit.

In another embodiment of the present invention, as shown in FIG. 5, lighting of bulbs 13 is controlled by a timer 22. The timer 22 is connected to the leads 15, 16 of the switch 12. The timer 22 includes a relay 25 as shown in FIG. 6. A first lead 28 from the battery pack 11 goes to a first switch post 33, and a second lead 29 is attached to a second switch post 34, as shown in FIG. 6. The second lead 29 then goes to a light bulb 13. The other light bulb 13 has lead wire 19 and lead wire 20 connected in circuit with the battery pack 11. First lead 23 and second lead 24 go from the battery pack 11 second lead wire 18 and first lead 28 to the timer 22 for power.

The timer circuit 30, as shown in FIG. 6, includes an integrated circuit chip 35 to control a light on timed cycle. The first switch post 31 and second switch post 32 act as a switch to set a timing cycle to actuate the relay 25 to turn on the bulbs 13.

FIG. 3 shows a detail of the switch 12 which is a reed switch. As shown, it has a first contact blade 36 and a second contact blade 37, which for the purpose of the present invention are normally biased closed. The magnet 21, as shown in FIG. 3, when in proper proximity, maintain the switch 12 open.

Operation

The purse 1, cut away as shown in FIG. 1, has the automated magnetic actuation system for inner illuminating 10 installed. The light bulbs 13 are mounted in sockets 14. The sockets 14 are preferably bayonet type. The battery pack 11 is secured in a zippered pocket 8. The magnet 21 is engaged on or in the purse flap 5. The aesthetics of the purse 1 dictate exactly where and how the magnet 21 is engaged. The magnet 21 is preferably Alnico®, selected to have the strength to maintain the blades 36, 37 in an open position. If, for aesthetic reasons, the magnet 21 is emplaced invisibly inside the purse flap 5, then it might be necessary for the magnet 21 to have greater power in order to maintain the blades 36, 37 biased open in the switch 12. The placement of the magnet 21 also has to be taken into account in selecting the strength of the magnet 21, as well as the spring tensions of the blades 36 and 37. The switch 12 may be invisibly placed.

It is preferred that the purse 1, or knapsack, or fanny pack have a separate closure 3, independent of the magnet 21 and switch 12 which can function as a separate closure 3.

As can best be seen in FIG. 2, the first lead wire 17 of the battery pack 11 is attached to the first lead wire 15 of the switch 12. The second lead wire 18 of the battery pack 11 goes to a socket 14 to complete a circuit with the light bulbs 13 when the switch 12 is closed. The lead wire 19 and lead wire 20 go to the other socket 14 so that both lights can be turned on at the same time.

When the purse flap 5 is moved in the direction of arrow A, the magnet 21 is juxtaposed to the switch 12, maintaining the automated magnetic actuation system for inner illuminating 10 off, maintaining the switch 12 open.

In the exploded view of FIG. 3, the magnet 21 is shown maintaining the switch 12 open.

FIG. 4 is a block schematic showing an operating embodiment of the present invention.

FIG. 5 discloses another embodiment of the present invention where a timer circuit 30 is actuated by the magnet 21 and switch 12. The first lead wire 15 of the switch 12 connected at the first switch post 31 and the second lead wire 16 is connected at the second switch post 32. When the switch 12 is closed, the timer circuit 30, controlled by the integrated circuit chip 35, actuates the relay 25 for a selected time. The first lead 28 from the battery pack 11 is connected to the first switch post 33; the second lead 29 is connected to the second switch post 34. The relay 25 acts as a switch normally open. When the switch 12 is closed, the relay 25 closes the circuit for the selected time, illuminating the purse 1 or any purse, knapsack or fanny pack in which the automated magnetic actuation system for inner illuminating 10 is engaged.

Among other things, the timer circuit 30 protects the battery pack 11 from running down from accidental actuation of the system, or from failure to reclose the purse 1. The integrated circuit chip 35 is a conventional integrated circuit chip programmed to operate the relay 25. The switch 12 is a normally open reed switch, obtainable from Hamlin of Lake Mills, Wis., Stock No. 59140-040, or also obtainable from United Security Products of San Diego, Calif., Stock No. 131SP.

The magnetic arrangements can open and close the circuitry for the normally open switches, or the normally closed switches.

The integrated circuit chip 35 is a conventional 555 timer chip. A particular version can be found at Radio Shack, Part No. 276-1723.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, may fall therebetween.

What is claimed is:

1. A lighting system for the inside of a nonrigid personal effects carrying container including a light source, a power source, and a switch, said light source, power source, and switch electrically interengaged in one circuit, said switch comprised of a reed switch and normally spring biased closed, said light source including at least one incandescent bulb, said power source including at least one battery, and said container including a pouch to hold said power source, said circuit also including means to time said circuit closed for a selected period of time; and said means to time actuated when said circuit is closed, said means to time including an integrated circuit, at least one relay and at least two switch posts, said integrated circuit electrically connected to said relay and said posts magnetic means, said magnetic means when in selected propinquity with said switch maintaining said switch open, said container further including an inner compartment and a flexible closure flap, said flexible closure flap having an inner surface and an outer surface, said flexible closure flap overfoldable over said inner compartment with said inner surface juxaposed to said container, and said magnetic means mounted directly on said inner surface of said flexible closure flap at a position selected to position said magnetic means in any plane in close propinquity to said switch to maintain said switch open when said flexible closure flap is overfolded over said inner compartment.

* * * * *